US007273203B2

(12) United States Patent
Carnevali

(10) Patent No.: US 7,273,203 B2
(45) Date of Patent: Sep. 25, 2007

(54) LOCKING DEVICE SUPPORT

(76) Inventor: Jeffrey D. Carnevali, 5957 Beach Dr. SW., Seattle, WA (US) 98136

( * ) Notice: Subject to any disclaimer, the term of this patent is extended or adjusted under 35 U.S.C. 154(b) by 423 days.

(21) Appl. No.: 11/064,777

(22) Filed: Feb. 23, 2005

(65) Prior Publication Data

US 2006/0186290 A1 Aug. 24, 2006

(51) Int. Cl.
*E05C 1/04* (2006.01)

(52) U.S. Cl. ..... 248/553; 248/221.11; 248/223.41; 70/171

(58) Field of Classification Search ..... 248/551–553, 248/221.11, 223.41, 500, 918; 403/315, 403/316, 319; 70/58, 62, 171
See application file for complete search history.

(56) References Cited

U.S. PATENT DOCUMENTS 4,603,829 A * 8/1986 Koike et al. ..... 248/553
4,627,589 A * 12/1986 Hotsumi ..... 248/346.03
4,714,303 A * 12/1987 Suzuki et al. ..... 312/7.1
5,154,456 A * 10/1992 Moore et al. ..... 292/162
5,193,890 A * 3/1993 Robertson et al. ..... 312/7.1
5,380,990 A * 1/1995 Baitz et al. ..... 235/7 R
5,709,367 A * 1/1998 Heintz et al. ..... 248/551

* cited by examiner

*Primary Examiner*—Anita King
*Assistant Examiner*—Steven M. Marsh
(74) *Attorney, Agent, or Firm*—Charles J. Rupnick

(57) ABSTRACT

An accessory device mounting platform includes a substantially rigid frame and a substantially rigid mating tray that are slidably interconnected along a first direction, the frame and tray include a tongue-and-groove slide mechanism arranged therebetween for sliding the tray relative to the frame relative to a first direction. A resilient biasing mechanism, such as a cantilevered flexure or tension spring, is coupled between the frame and a latch bolt portion of a clasp mechanism for biasing the latch bolt portion toward a latch strike plate mechanism formed in the tray. The latch strike plate mechanism is formed with an inclined surface that is positioned to engage a latch bolt portion of the clasp mechanism and is structured for deflecting the latch bolt away from the frame, while the resilient biasing mechanism of the clasp mechanism is structured for biasing the latch bolt back toward the frame.

21 Claims, 3 Drawing Sheets

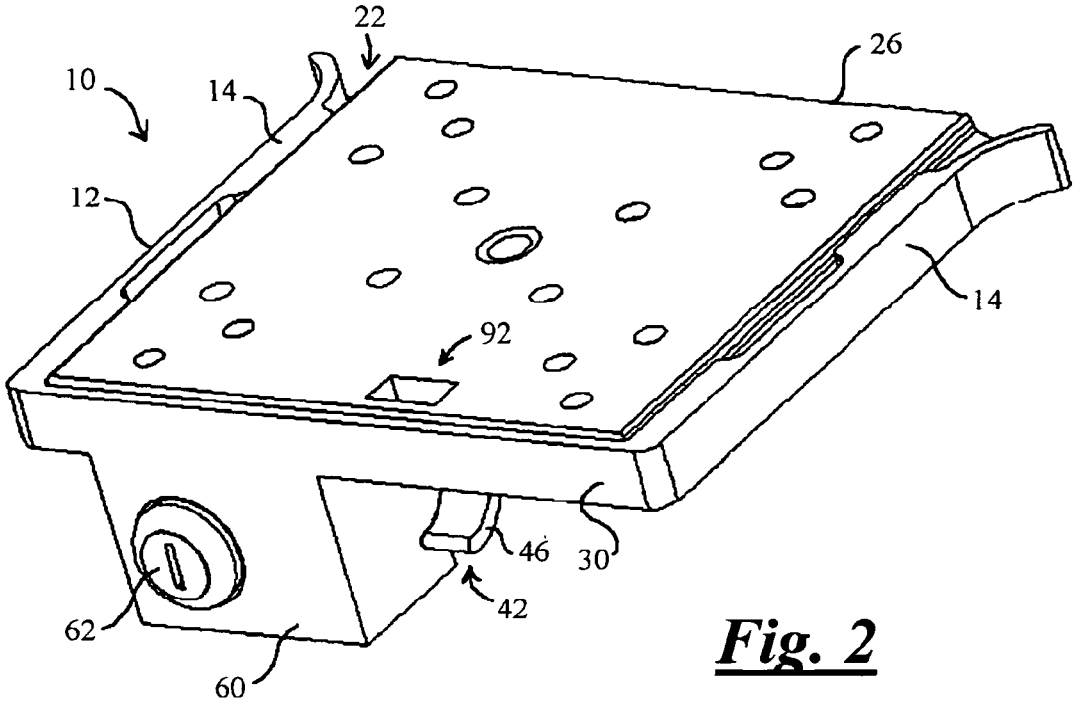
Fig. 2
Fig. 5
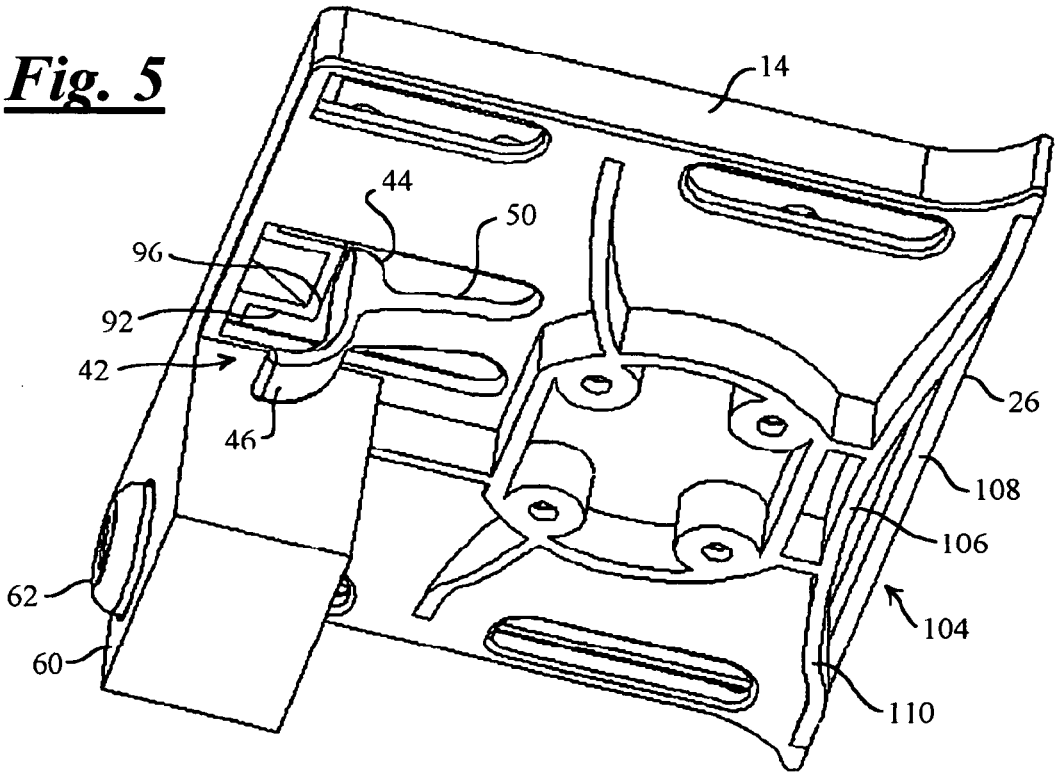

LOCKING DEVICE SUPPORT

FIELD OF THE INVENTION

The present invention relates to a means for removably attaching a device to a support base, and in particular to a means for slidably removably attaching a device attachment plate to a permanently supported base.

BACKGROUND OF THE INVENTION

Many after-market accessories being added in automobiles, airplanes and boats require specially designed mounting platforms that can accommodate the limited available space normally found in a vehicle for mounting add-on equipment. The mounting platform itself must be easily and quickly universally adjustable to provide maximum positional flexibility. The mounting platforms must also accommodate the various shapes of accessory devices being installed, while conforming to the limited, generally oddly-shaped space available in which to mount the platform and the accessory device. Furthermore, many of the accessories being added are valuable of themselves, and may through use contain information that is of significantly greater value than the as-purchased device. Lap top computers are such devices that through use accumulate value because the user's entry of data thereinto.

Although various mounting platforms are currently in use of different configurations that mount either on the vehicle's center console or dash board, the currently known mounting platforms permit easy removal of the device without the user's consent. In other words, such currently known mounting platforms permit easy theft of the device. Furthermore, currently known mounting platforms tend to permit the accessory device to slip within the mounting platforms when vibration or shock-induced forces act on the accessory device during motion of the vehicle. Such vibration or shock-induced forces are generally harmful to the device.

SUMMARY OF THE INVENTION

The present invention provides a mounting platform that overcomes the limitations of the prior art by providing a novel mounting platform for various vehicle-mounted, after-market accessory devices.

The present invention is an accessory device mounting platform that includes a substantially rigid frame and a substantially rigid mating tray that are slidably interconnected along a first direction, arranged between the frame and tray is a tongue-and-groove slide mechanism that is structured for sliding the tray relative to the frame relative to a first direction. A resilient biasing mechanism, such as a cantilevered flexure or tension spring, is mechanically coupled between the frame and a latch bolt portion of a clasp mechanism for biasing the latch bolt portion toward a latch strike plate mechanism formed in the tray. The latch strike plate mechanism is formed with an inclined surface that is positioned to engage a latch bolt portion of the clasp mechanism and is structured for deflecting the latch bolt away from the frame, while the resilient biasing mechanism of the clasp mechanism is structured for biasing the latch bolt back toward the frame.

According to one aspect of the invention, a keyed lock mechanism is provide in a substantially tamper-proof enclosure formed on the frame on an opposite side from a slide surface of the frame. The lock mechanism includes a bolt that is operable by a key, while the tray is formed with a lock mortise or plate structured to be engaged by the lock bolt for securing the tray relative to the frame.

Yet other aspects of the invention are described herein below.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 2 is a perspective assembly view of the mounting platform of the invention that illustrates a tray member of the invention being fully engaged with a mating drawer frame member of the invention;

FIG. 5 is another perspective assembly view of the mounting platform of the invention showing the bottom support attachment surface of the drawer frame of the invention and illustrating the tray member of the invention being fully engaged with the mating drawer frame member of the invention.

DETAILED DESCRIPTION OF PREFERRED EMBODIMENT

In the Figures, like numerals indicate like elements.

Figure 1:
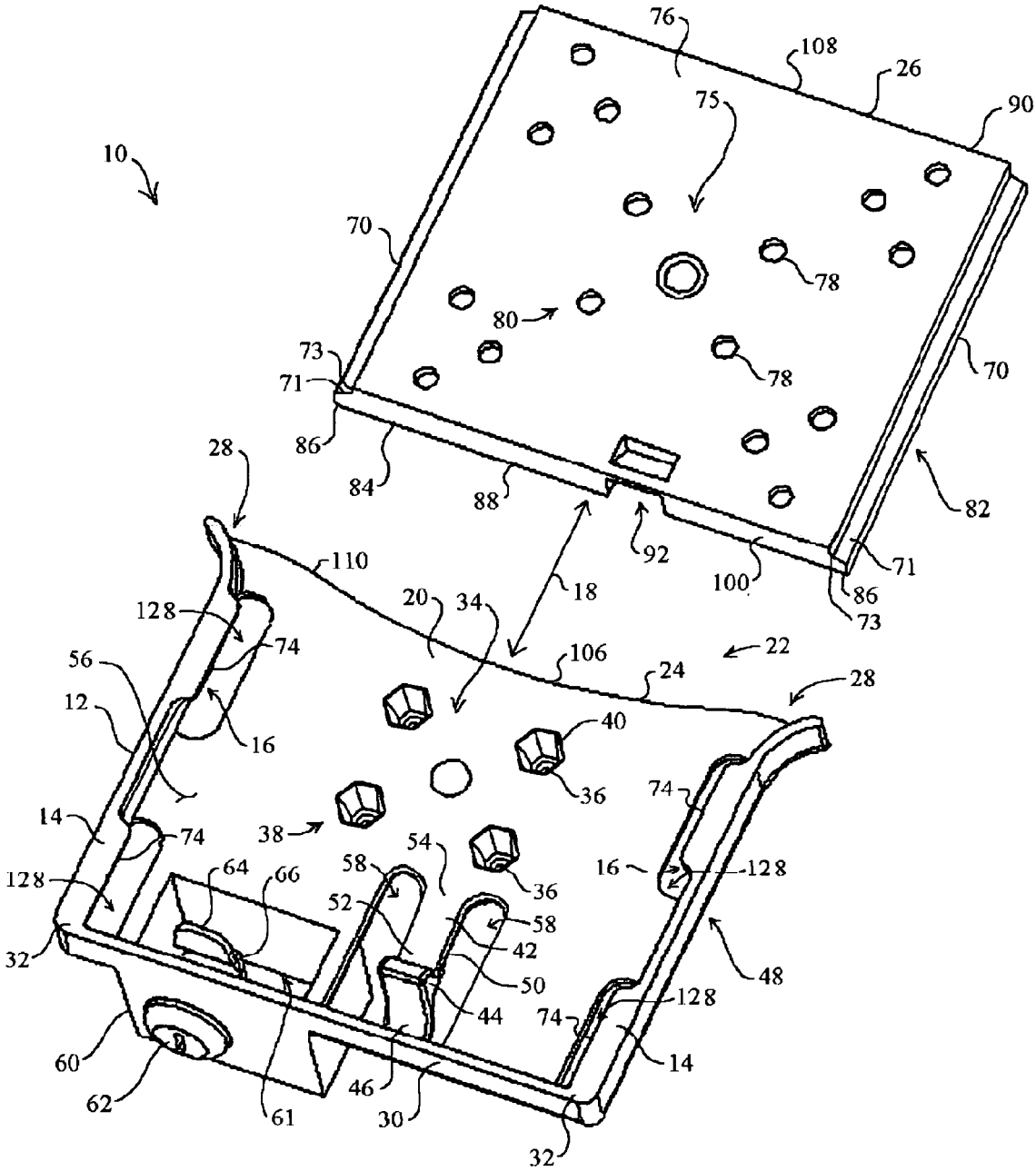
FIG. 1 is an exploded perspective view that illustrates the invention embodied as an exemplary mounting platform for various vehicle-mounted, after-market accessory devices, such as a portable computer, or another useful accessory device.

FIG. 1 is an exploded perspective view that illustrates the invention embodied as an exemplary mounting platform 10 for various vehicle-mounted, after-market accessory devices, such as a portable computer, or another useful accessory device. By example and without limitation, the mounting platform 10 includes a female drawer frame portion 12 having a pair of elongated grooved tracks 14 with opposing inwardly facing grooves 16 aligned along a first direction 18 and a generally rectangular slide 20 between the tracks 14. The tracks 14 have a mouth opening 22 at a first end 24 to receive a mating male tray 26 that is structured to receive an accessory device, such as a typical lap top computer or another valuable accessory device. The mouth opening 22 in the tracks 14 includes a lead-in 28 for guiding the tray 26 into the mouth opening 22. A fence 30 at a second end 32 of the tracks 14 operates as a stop for the tray 26.

The frame 12 includes an attachment structure 34 for connecting to an external support device. For example, the attachment structure 34 is configured as one or more apertures 36 through the slide 20. According to one embodiment of the invention, the apertures 36 are provided in a pattern configured to match a known support, for example, the compressible coupling member portion of the universally positionable mounting device shown and described in U.S. Pat. No. 5,845,885, "Universally Positionable Mounting Device," issued to the inventor of the present invention on Dec. 8, 1998, which is incorporated herein by reference in its entirety, and the support is the one shown and described in therein. Alternatively, the support is another suitable structure of conventional design. According to one embodiment of the invention, the apertures 36 are recessed beneath a smooth and substantially planar top slide surface 38 of the slide 20, whereby fasteners positioned therein for connecting the slide 20 to the support are recessed to avoid interference with receiving the tray 26. According to one embodiment of the invention, the apertures 36 include recesses 40 shaped to retain a fastener against turning during connecting to the support. For example, the recesses 40 are hexagonal in shape and are proportioned relative to the apertures 36 for receiving a standard hex fastener that is sized to pass through one of the apertures 36. Alternatively, the recesses 40 are shaped round in proportion to a standard socket head fastener, or are countersunk in proportion to a standard flat head fastener.

A clasp mechanism 42 is flexibly suspended relative to the slide surface 38 of the slide 20 is a positioned, by example and without limitation, adjacent to the fence 30 portion of the frame 12 to provide easy access. The clasp mechanism 42 is structured for retaining the tray 26 when fully inserted within the tracks 14. By example and without limitation, the clasp mechanism 42 includes a latch mechanism or "bolt" 44 that is, for example, a bar, pin or plate oriented upright relative to the slide surface 38. The latch mechanism 44 extends a short distance over the slide surface 38 between the tracks 14, but need not extend above the tracks 14. A trigger mechanism 46 is structured for deflecting the clasp mechanism 42 to an extent that the latch mechanism 44 is deflected beneath the slide surface 38. According to one embodiment of the invention, the trigger mechanism 46 is configured as a straight or curved handle that extends beyond an attachment surface 48 of the slide 20 opposite from the slide surface 38. For example, the trigger mechanism 46 extends beyond the attachment surface 48 far enough to be engaged by a user's finger or thumb. According to one embodiment of the invention, the latch and trigger mechanisms 44, 46 are mutually integral. Additionally, the latch and trigger mechanisms 44, 46 are integral with a resiliently deflectable flexure 50 that flexibly suspends both from the slide 20. For example, the integral latch and trigger mechanisms 44, 46 extend from opposite surfaces of the flexure 50 at a distal end 52 thereof that is spaced away from a connected end 54 of the flexure 50 that is integrally cantilevered from the slide 20. The flexure 50 of the clasp mechanism 42 is sufficiently resilient be deflected and yet to return the latch mechanism 44 to its normal position over the slide surface 38 between the tracks 14 after initial deflection below the slide surface 38. According to one embodiment of the invention, the flexure 50 is separated from a body portion 56 of the slide 20 by slots 58 on either side thereof. Additionally, the latch mechanism 44 is spaced away from the fence 30 between the first and second ends 24, 32 of the tracks 14. For example, the latch mechanism 44 is spaced away from the fence 30 about ½ inch to ¾ inch according to one embodiment of the invention.

According to one embodiment of the invention, the frame 12 further includes a substantially tamper-proof key lock enclosure 60 that is positioned, by example and without limitation, adjacent to the fence 30 portion of the frame 12 and the clasp mechanism 42 for easy access. According to one embodiment of the invention, the lock enclosure 60 is configured as a generally rectangular box having a single open access hole 61 that opens into the slide 20. The open access hole 61 provides easy access for installing a keyed lock mechanism 62, yet the open access hole 61 is closed by the installed tray 26 so that the lock mechanism is protected when the tray 26 having the accessory device thereon is installed on the frame 12. The lock enclosure 60 is structured to receive the lock mechanism 62 such as a key-operable locking mechanism of a type having a bolt 64 such as a bar, pin or plate, that is operable by a key for being rotated about a longitudinal axis of a lock cylinder 66. In a locked position (shown) the bolt 64 is oriented upright relative to the slide surface 38, and in an unlocked position the bolt 64 is rotated substantially 90 degrees crosswise relative to the slide surface 38. This type of keyed lock mechanism 62 is generally commercially available. The key lock enclosure 60 is arranged slide 20 and includes a lock mounting aperture 68 (shown in FIG. 3) that is positioned below the slide surface 38. The open access hole 61 provides clearance for the lock mechanism bolt 64 to reach above the slide surface 38 for engaging the tray 26. Accordingly, when the bolt 64 is rotated substantially 90 degrees into its unlocked position, the bolt 64 is arranged below the slide surface 38 and thus does not interfere with receiving or withdrawing the tray 26. However, when the bolt 64 is rotated into the locked position such that it is oriented upright relative to the slide surface 38, the bolt 64 interferes with receiving and, in particular, with withdrawing the tray 26 so that the tray 26 is inserted into the frame 12 and the lock mechanism is engaged with the tray 26, the tray 26 is securely locked in the frame 12 between the tracks 14.

According to one embodiment of the invention, the entire frame 12 is formed of a heavy gage substantially rigid plastic, whereby the lock enclosure 60 is substantially tamper-proof The flexure 50 of the clasp mechanism 42 is rendered resiliently flexible when the entire frame 12 is formed of a heavy gage substantially rigid plastic, and the latch and trigger mechanisms 44, 46 are rendered sufficiently sturdy to be reliably operated over and over again. Alternatively, the entire frame 12 is formed of a metal, such as aluminum, steel or stainless steel, whereby it is made substantially indestructible.

The tray 26 is sized substantially the same as the slide 20 of the frame 12 to fit between the tracks 14. The tray 26 includes opposing outwardly facing edge tongues 70 that are structured to engage the opposing track grooves 16 with very little either sideway or up-and-down play. According to one embodiment of the invention, the tongues 70 and grooves 16 are optionally formed with cooperatively relatively curved or inclined (shown) surfaces 71, 72 (shown in FIG. 3) so that the cooperative inclined surfaces 71, 72 tend to press the tray 26 toward the slide surface 38 of the slide 20.

According to one embodiment of the invention, opposing flats 73 are structured on each of the opposing outwardly facing edge tongues 70 of the tray 26 for engaging cooperating inwardly facing knife edges 74 formed along the most inward face of the opposing tracks 14. By example and without limitation, the opposing flats 73 are structured on each of the opposing outwardly facing edge tongues 70 adjacent to a device mounting surface 76 of the tray 26, and the cooperating knife edges 74 are structured adjacent to the track grooves 16 opposite from the slide surface 38. Engagement of the opposing edge flats 73 of the tray 26 with the cooperating inwardly facing knife edges 74 of the tracks 14 tends to center the tray 26 relative to the slide surface 38 of the slide 20.

The arrow indicating the first direction 18 also indicates the opposing insertion and release directions of the tray 26 relative to the frame 12.

The tray 26 includes accessory mounting structure 75 that is structured to substantially permanently receive an accessory device, such as a portable computer, or another useful accessory device. According to one embodiment of the invention, the tray 26 includes a first or top substantially planar device mounting surface 76 of generally rectangular shape wherein the accessory mounting structure 75 is provided as multiple device attachment apertures 78 formed through the tray mounting surface 76. The multiple device attachment apertures 78 are, for example, formed in any appropriate pattern 80 that is structured to accommodate the various accessory devices being installed, including for example different accessory device mounts such as a portable desk or laptop computer platform, for example, of the type described by Carnevali, the inventor of the present invention, in U.S. Pat. No. 6,585,212, issued Jul. 1, 2003, entitled "Quick Release Electronics Platform," which is incorporated herein by reference. The tray 26 is recessed at least in areas surrounding the apertures 78 on a second or bottom slide engagement surface 82 opposite from the device mounting surface 76, whereby fasteners positioned therein for connecting the accessory device to the tray 26 are recessed sufficiently to avoid interference with the slide surface 38 receiving the tray 26. According to one embodiment of the invention, the apertures 78 include recesses shaped to retain a fastener against turning during connecting the accessory device to the tray 26. For example, the recesses around the apertures 78 are hexagonal in shape and are proportioned relative to the apertures 78 for receiving a standard hex fastener that is sized to pass through one of the apertures 78. Alternatively, the recesses are shaped round in proportion to a standard socket head fastener, or are countersunk in proportion to a standard flat head fastener. Alternatively, a majority of the slide engagement surface 82 is relieved such that only a peripheral lip 84 remains around the tray 26. A portion of the peripheral lip 84 forms the two opposing edge tongues 70 and is further structured as a pair of runners 86 that stretch between first and second ends 88, 90 of the tray 26. The runners 86 are structured to slidingly engage the slide surface 38 of the slide 20 when the tray 26 is engaged with the frame 12 having the opposing edge tongues 70 engaged with the grooves 16 in the opposing tracks 14.

The tray 26 is structured to be releasably secured to the frame 12 within the tracks 14. According to one embodiment of the invention, the tray 26 includes a latch strike plate mechanism 92 that is structured to engage the clasp mechanism 42 of the frame 12. According to one embodiment of the invention best shown in FIG. 4, the strike plate 92 includes an inclined latch ramp 94 terminating in a recessed latch mortise face or plate 96 that is structured to securely engage with the latch mechanism 44. The ramp 94 is configured having a lower end 98 that proximal to the device mounting surface 76 of the tray 26 and adjacent to a face 100 that forms the first end 88 of the tray 26 between the opposing edge tongues 70 that are structured to engage the opposing track grooves 16. The ramp 94 terminates at a second higher end 102 that is both spaced away from the bottom slide engagement surface 82 and distal from the tray face 100.

The inclined latch ramp 94 is positioned adjacent to the tray face 100 and is thus positioned to engage the latch mechanism or bolt 44 when the tray 26 is inserted into the tracks 14 of the frame 12, and the tray face 100 is slid toward the fence 30 adjacent to the second end 32 of the tracks 14. As the tray face 100 approaches the fence 30 in the frame 12, the lower proximal end 98 of the ramp 94 engages the undeflected latch mechanism 44 in the slide surface 38 of the slide 20. Further engagement of the inclined ramp 94 with the undeflected latch mechanism 44 causes the latch mechanism 44 travel along the inclined ramp 94 toward the second higher distal end 102. Engagement with the inclined ramp 94 thus causes the latch mechanism 44 to be increasingly deflected below to the slide surface 38 of the slide 20. The inclined ramp 94 is positioned such that, before the face 100 of the tray 26 reaches the fence 30 of the frame 12, the latch mechanism or bolt 44 reaches the second higher distal end 102. Upon reaching and passing slightly beyond the second higher distal end 102 of the ramp 94, the now fully deflected latch mechanism 44 is forcibly snapped into place behind the second higher distal end 102 of the ramp 94 under pressure exerted thereon by the resilient flexure 50, whereupon the latch mechanism 44 engages the recessed latch mortise face 96 on the far side of the strike plate 92 distal from the face 100 of the tray 26. Engagement of the latch mechanism 44 with the mortise or recessed latch mortise face 96 securely engages the tray 26 with the frame 12. For example, according to one embodiment of the invention, the mortise face or latch mortise face 96 is positioned about 9/16 inch away from the face 100 of the tray 26 when the latch mechanism 44 is spaced away from the fence 30 about 5/8 inch. The latch mortise face 96 is optionally positioned away from the face 100 of the tray 26 a similarly proportional distance when the latch mechanism 44 is spaced closer or further away from the fence 30. The combination of the clasp mechanism 42 and the latch strike plate mechanism 92 thus operates similarly to a one-time ratchet device.

According to one embodiment of the invention, the latch mechanism 44 and the recessed latch mortise face 96 are optionally cooperatively relatively curved or inclined so that the cooperative inclined surfaces tend to press the face 100 of the tray 26 toward the fence 30 of the frame 12.

The tray 26 is released from the frame 12 by withdrawing the latch mechanism 44 from the recessed latch mortise face 96, and sliding the tray 26 away from the fence 30 toward and out of the mouth opening 22 at the first end 24 of the tracks 14. The latch mechanism 44 is withdrawn from the recessed latch mortise face 96 by deflecting, for example manually deflecting, the latch mechanism relative to the recessed latch mortise face 96 sufficiently that the latch mechanism 44 clears the recessed latch mortise face 96, whereupon the tray 26 can be slid relative to the slide 20 at least sufficiently to reposition the latch mechanism 44 onto the inclined latch ramp 94. Thereafter, the tray 26 is easily slid along the tracks 14 and released from the frame 12.

According to one embodiment of the invention, the frame 12 and tray 26 are cooperatively structured to provide a hand hold 104 (best shown in FIG. 5) for withdrawing the tray 26 from between the tracks 14 on the frame 12 when an accessory device is not emplaced on the tray 26 for pushing or pulling thereon. The hand hold 104 is also useful even when an accessory device is emplaced on the tray 26: the hand hold 104 permits withdrawing the tray 26 without resort to pushing or pulling on the accessory device directly. According to one embodiment of the invention, the hand hold 104 for withdrawing the tray 26 is configured as a finger relief 106 on the slide 20 portion of the frame 12 and a cooperating lip 108 structured on the second end 90 of the tray 26 opposite from the face 100 that forms the first end 88 of the tray 26 for engaging the frame fence 30. The lip 108 is structured to provide a finger hold adjacent to the slide engagement surface 82 of the tray 26. Alternatively, the hand hold 104 is structured as a knob or drawer pull coupled to an outer surface of the second end 90 of the tray 26, and the finger relief 106 on the slide 20 is eliminated such that the a surface 110 of the slide 20 within the mouth opening 22 between the tracks 14 is substantially planar and optionally flush with the mouth opening 22.

Figure 4:
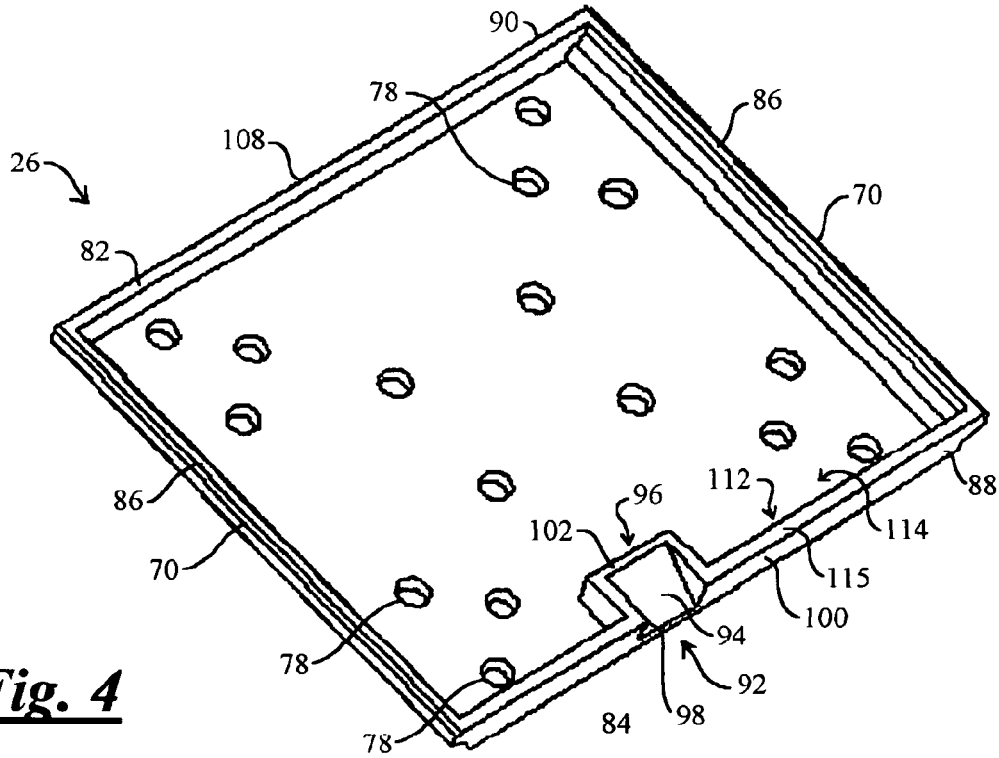
FIG. 4 is a perspective view of the tray of the invention showing a second slide engagement surface opposite from a device mounting surface thereof.

As best shown in FIG. 4, the first end 88 of the tray 26 is further structured with a key lock mechanism strike plate 112 for engaging the bolt 64 of the keyed lock mechanism 62 when it is rotated into the locked position, as shown. By example and without limitation, according to one embodiment of the invention, the lock mechanism strike plate 112 is provided by a mortise recess or relief 114 formed in the slide engagement surface 82 of the tray 26. According to another embodiment of the invention, the lock mechanism strike plate 112 is provided by a lip 115 formed on a distal surface of the face 100 of the tray 26.

According to one embodiment of the invention, the entire tray 26 is formed of a heavy gage substantially rigid plastic similar to the frame 12, whereby the lock mechanism strike plate 112 for engaging the bolt 64 of the lock mechanism 62 is substantially tamper-proof The device attachment apertures 78 are also rendered substantially tamper-proof when the entire tray 26 is formed of a heavy gage substantially rigid plastic. Also, the opposing edge tongues 70 and runners 86 by which the tray 26 engages the frame 12 are rendered sufficiently sturdy to be reliably operated over and over again. Alternatively, the entire tray 26 is formed of a metal, such as aluminum, steel or stainless steel, whereby it is made substantially indestructible.

According to one or more embodiments of the invention, the frame 12 and mating tray 26 are manufactured of materials having substantially similar surface hardness and wear coefficients so that wear rates are minimized.

Alternatively, skids are provided between the tray runners 86 and the slide surface 38 of the slide 20 as a sacrificial member for minimizing wear rates of both the tray runners 86 and the slide surface 38. By example and without limitation, the skids are formed of a material having a relatively low coefficient of friction, such as plastic, nylon or Teflon™.

FIG. 2 is an assembly view of the mounting platform 10 of the invention that illustrates the tray 26 fully engaged with the drawer frame 12, having the opposing edge tongues 70 engaged with the opposing grooves 16 of the tracks 14 and the clasp mechanism 42 engaged with the latch strike plate mechanism 92, whereby the tray 26 is secured relative to the frame 12.

Figure 3:
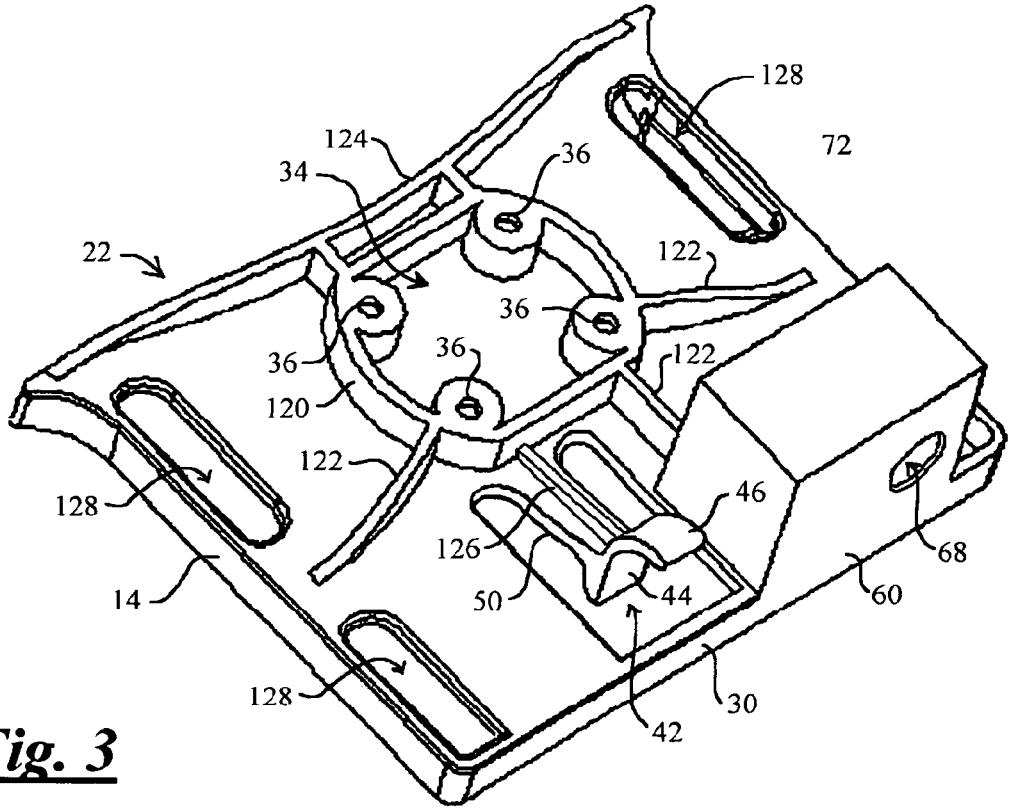
FIG. 3 is a perspective view showing a bottom support attachment surface of the drawer frame of the invention.

FIG. 3 is a perspective view showing a bottom support attachment surface 116 of the frame 12 opposite from the top slide surface 38. The support attachment surface 116 of the frame 12 includes the attachment structure 34 for connecting to the support device. By example and without limitation, the attachment structure 34 is configured as the apertures 36 through the slide 20. According to one embodiment of the invention, the apertures 36 are provided through individual bosses 118 supported by an integral collar 120. One or more gussets 122 are optionally formed integrally with the bosses 118 and collar 120 for additional strength and ruggedness. One or more of the gussets 122 extend between the collar 120 and each of the lock enclosure 60 and a crosswise stiffener 124 for stiffening the frame 12 crosswise of the tracks 14. The stiffener 124 simultaneously operates as a guide for placement of the user's fingers relative to the lip 108 on the second end 90 of the tray 26 when removing the tray 26 from the frame 12. Also illustrated is one or more flexure stiffener 126 on the flexure 50 for ensuring sufficient resiliency for returning the latch mechanism 44 after deflection. The frame 12 is optionally formed with one or more open holes or slots 128 in areas where the tray runners 86 engage the slide surface 38. These open slots 128 or other relief structures in the slide surface 38 reduce engagement of the runners 86 with the slide surface 38 and thus reduce the frictional drag experienced while inserting and removing the tray 26.

FIG. 4 is a perspective view of the tray 26 showing the second slide engagement surface 82 opposite from the top device mounting surface 76. The tray 26 is shown by example and without limitation as having a majority of the slide engagement surface 82 relieved such that only the peripheral lip 84 remains. Accordingly, the slide engagement surface 82 is recessed at least in areas surrounding the apertures 78, whereby fasteners positioned therein for connecting the accessory device to the tray 26 are recessed sufficiently to avoid interference with the slide surface 38 receiving the tray 26. As illustrated, the peripheral lip 84 forms the pair of runners 86 on the two opposing edge tongues 70 with the runners 86 extending between the first and second ends 88, 90 of the tray 26.

Also illustrated is the latch strike plate mechanism 92 that is structured to engage the clasp mechanism 42 of the frame 12. As illustrated, the inclined latch ramp 94 of the strike plate 92 ends in the latch mortise face 96 that is recessed relative to the terminal second higher end 102 of the inclined latch ramp 94, which is elevated relative to the relieved slide engagement surface 82. Also illustrated is the lip 108 structured on the second end 90 of the tray 26 opposite from the face 100 that forms the tray portion of the hand hold 104 for withdrawing the tray 26 from the frame 12. Also illustrated is the lock mechanism strike plate 112 for engaging the bolt 64 of the lock mechanism 62, the lock mechanism strike plate 112 being formed by example and without limitation as the lip 115 formed on a distal surface of the face 100 of the tray 26.

FIG. 5 another perspective assembly view of the mounting platform 10 of the invention showing the bottom support attachment surface 48 of the drawer frame 12 of the invention and illustrating the tray 26 of the invention being fully engaged with the mating drawer frame 12. Also shown is the external support device attachment structure 34. According to one embodiment of the invention, the external support device is coupled to the attachment structure 34. For example, the external support device is the compressible coupling member portion of the universally positionable mounting device shown and described in U.S. Pat. No. 5,845,885, which is coupled to the attachment structure 34 of the frame 12 via one or more fasteners.

While the preferred embodiment of the invention has been illustrated and described, it will be appreciated that various changes can be made therein without departing from the spirit and scope of the invention. For example, the tracks 14 are optionally rendered on the tray 26, while the mating tongues 70 are rendered on the outside of the frame 12, whereby tray 26 is alternatively rendered as a female tray, and the frame 12 is alternatively rendered as a mating male frame.

According to another alternative embodiment of the invention, the grooves 16 of the tracks 14 are outwardly facing, while the mating tongues 70 are arranged outboard of the tracks 14 and are oriented inwardly facing for engaging the outwardly facing grooves 16.

According to other alternative embodiments of the invention, the mouth opening 22 at the first end 24 of the tracks 14 is in line with the remainder of the grooves 16, while the opposing edge tongues 70 are narrowed or inwardly inclined, whereby the lead-in 28 for guiding the tray 26 into the mouth opening 22 is provided as part of the tray 26, rather than as part of the frame 12, as illustrated.

According to still other alternative embodiments of the invention, the clasp mechanism 42 is rendered as part of the tray 26, while the mating latch strike plate mechanism 92 is rendered as part of the frame 12.

According to yet other alternative embodiments of the invention, the lock enclosure 60 and lock mechanism 62 are rendered as part of the tray 26, while the mating lock mechanism strike plate 112 is rendered as part of the frame 12.

Accordingly, having described the various embodiments of the present invention with reference to the accompanying figures, it will appreciated that various changes and modifications can be made without departing from the scope or spirit of the invention.

I claim:

1. A mounting platform, comprising:

a frame;

a tray;

a mating tongue-and-groove mechanism structured between the frame and tray, the mating tongue-and-groove mechanism being structured for mutual relative slidably releasable engagement of the frame and tray;

a clasp mechanism and mating latch strike plate mechanism structured between the frame and tray, the clasp mechanism and mating latch strike plate mechanism being structured for releasable mutual relative slidable engagement thereof;

a keyed lock mechanism between the frame and tray, the lock mechanism being structured for releasable mutual securing of the frame and tray;

attachment structure for securing the frame to an external support device; and accessory mounting structure for receiving an external accessory device.

2. The mounting platform of claim 1 wherein the mating tongue-and-groove mechanism further comprises a lead-in structure.

3. The mounting platform of claim 1 wherein the clasp mechanism further comprises a resiliently deflectable latch mechanism, and wherein the mating latch strike plate mechanism further comprises an inclined latch ramp that is structured to deflect the latch mechanism.

4. The mounting platform of claim 3 wherein the inclined latch ramp further comprises a latch plate at a terminal end thereof.

5. The mounting platform of claim 3 wherein the clasp mechanism further comprises a trigger mechanism.

6. The mounting platform of claim 3 wherein the clasp mechanism further comprises a resiliently flexible biasing mechanism having the deflectable latch mechanism coupled thereto.

7. The mounting platform of claim 1, further comprising a lock enclosure wherein the lock mechanism is substantially enclosed during engagement of the frame and tray.

8. The mounting platform of claim 1, further comprising one or more runners between the frame and tray, the one or more runners being structured for mutual relative slidable engagement of the frame and tray.

9. A mounting platform, comprising:

a substantially rigid frame structured for being secured to an external support device, the frame including a pair of tracks having opposing inwardly facing grooves separated by a slide surface;

a substantially rigid mating tray structured for securing an external accessory device thereto, the tray including a pair of opposing outwardly facing tongues that are structured to slidingly engage the grooved tracks;

a resiliently deflectable clasp mechanism formed in one of the frame and tray;

a latch strike plate mechanism formed in a different one of the frame and tray than the clasp mechanism, the latch strike plate mechanism being positioned to engage the clasp mechanism and being structured to deflect the clasp mechanism and further to securely engage a latch mechanism portion of the clasp mechanism;

a keyed lock mechanism provided in a lock mechanism enclosure formed in one of the frame and tray; and a lock mechanism strike plate formed in a different one of the frame and tray than the lock mechanism, the lock mechanism strike plate being positioned to engage a bolt portion of the lock mechanism.

10. The mounting platform of claim 9 wherein the clasp mechanism is formed in the frame, and the latch strike plate mechanism is formed in the tray.

11. The mounting platform of claim 9 wherein the lock mechanism enclosure is formed in the frame, and the lock mechanism strike plate is formed in the tray.

12. The mounting platform of claim 9 wherein the tray further comprises one or more runners structured for sliding the tray relative to frame.

13. The mounting platform of claim 10 wherein each of the tongues further comprises one of the runners.

14. The mounting platform of claim 9 wherein the opposing inwardly facing grooves further comprise opposing inwardly facing inclined surfaces, and the opposing outwardly facing tongues further comprise opposing outwardly facing inclined surfaces structured to slidingly mate with the opposing inwardly facing inclined surfaces of the opposing inwardly facing grooves for urging the tray toward the slide surface of the frame.

15. The mounting platform of claim 9 wherein the latch mechanism portion of the clasp mechanism and the latch strike plate mechanism further comprise mutually cooperatively shaped surfaces structured to urge the tray toward a fence portion of the frame.

16. The mounting platform of claim 9 wherein the clasp mechanism further comprises a resiliently deflectable flexure having the latch mechanism portion adjacent to one end thereof.

17. A mounting platform, comprising:

a substantially rigid frame that is structured for being secured to an external support device, the frame including a slide portion having a slide surface and further including a pair of tracks adjacent to opposite first and second sides of the slide surface with the tracks having opposing inwardly facing grooves that are substantially aligned along a first direction of the slide surface;

a substantially rigid mating tray structured for securing an external accessory device thereto, the tray including a pair of opposing outwardly facing tongues adjacent to opposite sides thereof that are structured to slidingly engage the grooved tracks;

a resiliently deflectable clasp mechanism formed in the frame adjacent to the slide surface and spaced away from a stop portion of the frame that is arranged adjacent to a third side of the slide surface;

a latch strike plate mechanism formed in the tray, the latch strike plate mechanism being positioned to engage the clasp mechanism and being structured to deflect the clasp mechanism and further to securely engage a latch bolt portion of the clasp mechanism;

a keyed lock mechanism provided in a substantially tamper-proof enclosure that is formed in the slide portion of the frame opposite from the slide surface; and a lock mechanism strike plate formed in the tray, the lock mechanism strike plate being positioned to securely engage a bolt portion of the lock mechanism.

18. The mounting platform of claim 17 wherein each of the tongues further comprises a runner that is structured for sliding the tray relative to sliding surface of the frame.

19. The mounting platform of claim 17 wherein the resiliently deflectable clasp mechanism further comprises a resiliently deflectable flexure formed in the slide portion of the frame and having the latch bolt portion of the clasp mechanism suspended thereon.

20. The mounting platform of claim 19 wherein the latch strike plate mechanism portion of the tray further comprises an inclined latch ramp structured for deflecting the latch bolt portion of the clasp mechanism, the latch strike plate mechanism terminating in a latch mortise face that is structured to securely engage with the latch bolt portion of the clasp mechanism.

21. The mounting platform of claim 20 wherein at least one of the latch bolt portion of the clasp mechanism and the latch plate portion of the latch mortise face further comprises an inclined surface structured to urge the tray toward the stop portion of the frame.

* * * * *